US009995299B2

(12) United States Patent
Choi

(10) Patent No.: US 9,995,299 B2
(45) Date of Patent: Jun. 12, 2018

(54) PISTON PUMP FOR BRAKE

(71) Applicant: Hyundai Mobis Co., Ltd., Seoul (KR)

(72) Inventor: Young Chang Choi, Yongin-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 334 days.

(21) Appl. No.: 14/689,873

(22) Filed: Apr. 17, 2015

(65) Prior Publication Data

US 2016/0160847 A1 Jun. 9, 2016

(30) Foreign Application Priority Data

Dec. 4, 2014 (KR) ..... 10-2014-0172780

(51) Int. Cl.

| | |
|---|---|
| ***F04B 49/12*** | (2006.01) |
| ***F04B 49/16*** | (2006.01) |
| ***F04B 53/12*** | (2006.01) |
| ***F04B 53/14*** | (2006.01) |
| ***F04B 1/04*** | (2006.01) |

(52) U.S. Cl.

CPC ..... *F04B 53/126* (2013.01); *F04B 1/0408* (2013.01); *F04B 1/0452* (2013.01); *F04B 53/12* (2013.01); *F04B 53/14* (2013.01); *F04B 53/145* (2013.01)

(58) Field of Classification Search

CPC ..... B60T 13/00–13/14; B60T 13/74–13/748; B60T 17/02; B60T 17/08; B60T 7/00; B60T 7/06; B60T 8/404; B60T 8/42; B60T 13/161; B60T 13/168; B60T 13/18; B60T 11/224; B60T 60/577; F04B 53/12; F04B 53/125–53/129; F04B 1/0408; F04B 1/0439; F04B 1/0452–1/0465

USPC ..... 417/274, 470

See application file for complete search history.

(56) References Cited

U.S. PATENT DOCUMENTS 2,102,834 A * 12/1937 Carroll ..... B60T 11/16 188/152
2,111,310 A * 3/1938 Carroll ..... B60T 11/224 60/587
2,820,347 A * 1/1958 Highland ..... B60T 11/224 60/578

(Continued)

FOREIGN PATENT DOCUMENTS

JP 11-512055 10/1999
JP 2010-159872 7/2010

(Continued)

*Primary Examiner* — Peter J Bertheaud
*Assistant Examiner* — Geoffrey Lee
(74) *Attorney, Agent, or Firm* — H.C. Park & Associates, PLC

(57) ABSTRACT

A piston pump for a brake including: a piston housing; an outer piston which rectilinearly reciprocates in the piston housing; an inner piston which is coupled to an inner portion of the outer piston, and rectilinearly reciprocates together with the outer piston in a state in which the inner piston is coupled to the inner portion of the outer piston, or rectilinearly reciprocates alone in a state in which the outer piston is stopped; an outer return spring which supports a tip portion of the outer piston; an inner return spring which supports a tip portion of the inner piston; and a piston rod spring which supports rear end portions of the outer piston and the inner piston.

9 Claims, 3 Drawing Sheets

(56) References Cited

U.S. PATENT DOCUMENTS

| | | | | | |
|---|---|---|---|---|---|
| 3,489,465 | A * | 1/1970 | Bueler | B60T 8/1831 | 137/38 |
| 3,684,330 | A * | 8/1972 | Kito | B60T 13/141 | 303/10 |
| 6,033,036 | A * | 3/2000 | Ruffer | B60T 7/042 | 188/358 |
| 6,093,003 | A * | 7/2000 | Hauser | B60T 8/4031 | 417/523 |
| 6,146,115 | A * | 11/2000 | Alaze | B60T 8/4031 | 417/415 |
| 6,471,496 | B1 * | 10/2002 | Merklein | B60T 8/4031 | 417/554 |
| 2011/0089753 | A1 * | 4/2011 | Schuller | B60T 8/4031 | 303/11 |
| 2011/0239857 | A1 * | 10/2011 | Iyatani | B60T 8/4031 | 92/163 |
| 2012/0042776 | A1 * | 2/2012 | Gaertner | B60T 11/236 | 92/172 |
| 2014/0363324 | A1 | 12/2014 | Braun | | |

FOREIGN PATENT DOCUMENTS

| | | |
|---|---|---|
| KR | 10-0771020 | 10/2007 |
| KR | 1020140104441 | 8/2014 |

* cited by examiner

PISTON PUMP FOR BRAKE

CROSS-REFERENCE TO RELATED APPLICATION

This application claims priority from and the benefit of Korean Patent Application No. 10-2014-0172780, filed on Dec. 4, 2014, which is hereby incorporated by reference for all purposes as if fully set forth herein.

BACKGROUND

Field

Exemplary embodiments relate to a piston pump for a brake, which is capable of increasing a discharge rate of the pump by allowing both an outer piston and an inner piston to be operated when low pressure is applied to an outlet, and reducing a load applied to a motor by allowing only the inner piston to be operated when high pressure is applied to the outlet.

Discussion of the Background

In general, a piston pump for a vehicle brake discharges brake oil at a wheel side to a master cylinder when reducing wheel pressure. Conversely, a piston pump for a vehicle brake discharges the brake oil at the master cylinder side to the wheel side when increasing wheel pressure. An operation of the piston pump for a brake is performed as follows. The brake oil flows into an inlet, and an inlet ball is opened. When the brake oil flows into the sleeve, the inlet ball is closed. By an operation of a motor cam, a piston is moved forward to the opposite side of the cam, and an outlet ball is opened. The brake oil is discharged to an outlet through an orifice. Meanwhile, in order to discharge a large amount of brake oil per time, the piston pump for a brake may increase discharge volume by increasing an outer diameter of the piston, and may increase a discharge amount of the pump by improving performance of a motor.

However, in a case in which the outer diameter of the piston of the piston pump for a brake is increased, there are problems in that high pressure is applied to the outlet of the pump as the outer diameter of the piston is increased, and a pressure load applied to the piston of the pump is increased, such that a high load is also applied to the motor, and as a result, durability of the motor deteriorates. Because a capacity of the motor needs to be increased in order to improve performance of the motor, there is a problem in that price and weight of the motor are increased.

For example, Korean Patent Application Laid-Open No. 10-2014-0104441 discloses "Piston Pump for Vehicle Brake System".

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a piston pump for a brake, which is capable of increasing a discharge rate of the pump by allowing both an outer piston and an inner piston to be operated when low pressure is applied to an outlet, and reducing a load applied to a motor by allowing only the inner piston to be operated when high pressure is applied to the outlet.

Additional aspects will be set forth in the detailed description which follows, and, in part, will be apparent from the disclosure, or may be learned by practice of the inventive concept.

An exemplary embodiment discloses, a piston pump for a brake including: a piston housing; an outer piston that can rectilinearly reciprocate in the piston housing; an inner piston coupled to an inner portion of the outer piston, and that can rectilinearly reciprocate together with the outer piston in a state in which the inner piston is coupled to the inner portion of the outer piston, or can rectilinearly reciprocate alone in a state in which the outer piston is stopped; an outer return spring supporting a tip portion of the outer piston; an inner return spring supporting a tip portion of the inner piston; and a piston rod spring supporting rear end portions of the outer piston and the inner piston.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
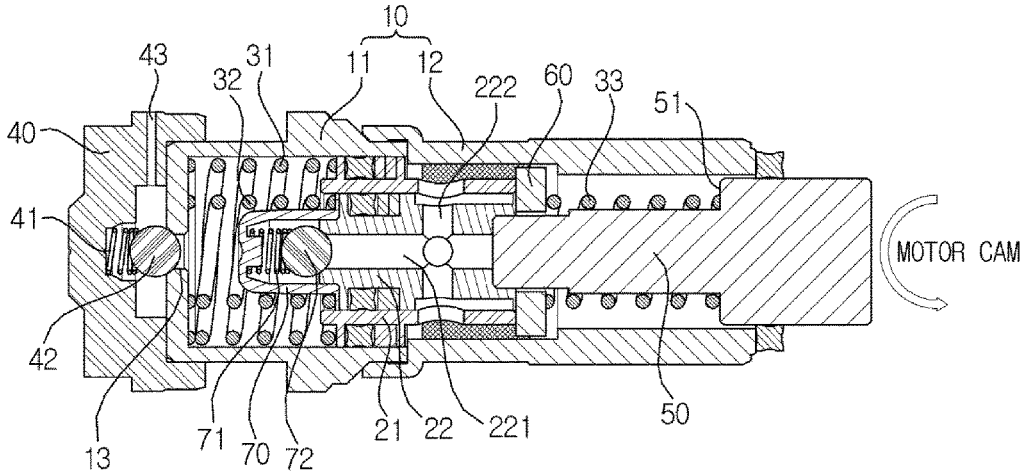
FIG. 1 is an overall configuration view of a piston pump for a brake according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

First, a configuration of a piston pump for a brake according to an exemplary embodiment of the present invention will be described.

As illustrated in FIG. 1, a piston pump for a brake according to an exemplary embodiment of the present invention includes a piston housing 10, an outer piston 21 that rectilinearly reciprocates in the piston housing 10, and an inner piston 22 coupled to an inner portion of the outer piston 21, and rectilinearly reciprocates together with the outer piston 21, or rectilinearly reciprocates alone in accordance with pressure applied on an outlet 43.

Specifically, the piston housing 10 provides a space in which the outer piston 21 and the inner piston 22 rectilinearly reciprocate. The piston housing 10 includes a sleeve 11, and a filter 12 which has a front portion that is coupled to a rear end portion of the sleeve 11.

The outer piston 21 rectilinearly reciprocates in the piston housing 10. A tip portion of the outer piston 21 is supported by an outer return spring 31 that is provided at a front side of the interior of the sleeve 11.

The inner piston 22 is coupled to the inner portion of the outer piston 21. A tip portion of the inner piston 22 is supported by an inner return spring 32 that is provided at the front side of the interior of the sleeve 11. The inner return spring 32 may be formed to have a smaller outer diameter than the outer return spring 31 because the inner piston 22, which is supported by the inner return spring 32, has a smaller outer diameter than the outer piston 21.

The inner piston 22 may be differently operated depending on pressure applied to the outlet 43. That is, when pressure, which is lower than force of a piston rod spring 33, is applied to the outlet 43, the inner piston 22 rectilinearly reciprocates together with the outer piston 21 in a state in which the inner piston 22 is coupled to the outer piston 21. On the contrary, when pressure, which is higher than force of the piston rod spring 33, is applied to the outlet 43, only the inner piston 22 rectilinearly reciprocates alone in a state in which the outer piston 21 is stopped.

An inner passageway 221, through which brake oil passes, is formed at a center of the interior of the inner piston 22. An inlet 222, which communicates with the inner passageway 221, is provided at one side of the inner piston 22.

A spring cage 70 is coupled to a front portion of the inner piston 22. An inlet ball 72, which is supported by an inlet spring 71 and opens and closes the inner passageway 221 of the inner piston 22, is provided in the spring cage 70. In order to stably couple the inlet spring 71, a protruding portion, with which a tip portion of the inlet spring 71 is fitted, may be provided in the spring cage 70.

Meanwhile, a cap 40 is coupled to a front portion of the sleeve 11. An outlet valve 42, which is supported by an outlet spring 41 and opens and closes an opening and closing hole 13 that is formed at a center of the front portion of the sleeve 11, is provided in the cap 40. A shape of the outlet valve 42 is not limited, and for example, the outlet valve 42 may be formed in the form of a ball, a plate, or the like.

In order to stably couple the outlet spring 41, a recessed portion, into which a tip portion of the outlet spring 41 is fitted, may be provided in the cap 40. The outlet 43, through which the brake oil passing through the opening and closing hole 13 is discharged, is provided at one side of the cap 40. The outlet 43 may be formed as an outlet that is formed at one side of the cap 40 so as to communicate with the interior of the cap 40, or as an outlet that is formed using a separate member.

A piston rod 50 is coupled to a rear end portion of the inner piston 22. The piston rod 50 is operated forward and backward in conjunction with an operation of a motor cam (not illustrated), and transmits the operational force thereof to the outer piston 21 and the inner piston 22. A stepped portion 51 is provided at a rear end of the piston rod 50.

A stopper plate 60 is fitted with and coupled to the piston rod 50. The stopper plate 60 is in close contact with rear end portions of the outer piston 21 and the inner piston 22. The piston rod spring 33 is coupled between the stopper plate 60 and the stepped portion 51 of the piston rod 50. Therefore, the stopper plate 60 may be in close contact with the rear end portions of the outer piston 21 and the inner piston 22 by the piston rod spring 33.

Meanwhile, connection portions between the respective members, which constitute the piston pump for a brake according to the exemplary embodiment of the present invention, need to be sealed to prevent the brake oil from leaking to the outside when the piston pump for a brake is in operation. For the purpose of providing an airtight seal, piston seals may be provided on outer circumferential surfaces of the outer piston 21 and the inner piston 22.

Next, an operation of the piston pump for a brake when pressure applied to the outlet is less than force of the piston rod spring will be described.

Figure 2A:
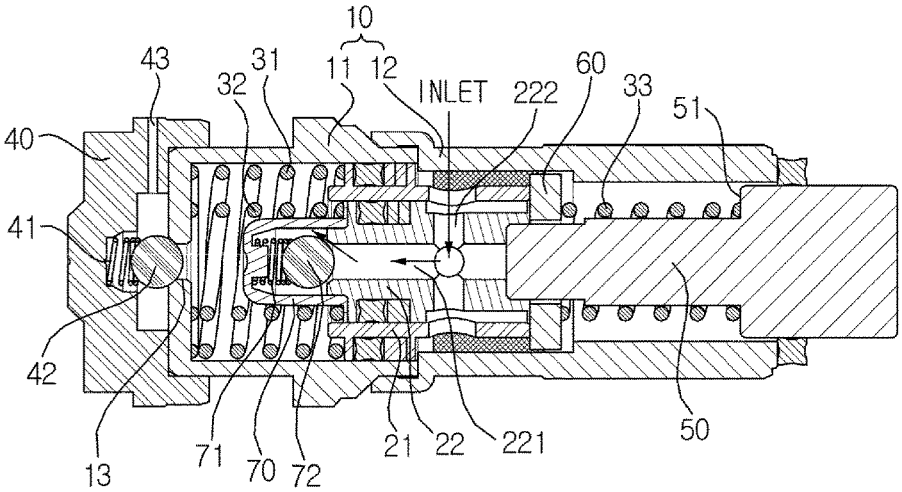
FIG. 2A and FIG. 2B are views illustrating an operating state of the piston pump for a brake according to the exemplary embodiment of the present invention when force lower than force of a piston rod spring is applied to an outlet.

As illustrated in FIG. 2A, when the brake oil flows into the inner passageway 221 of the inner piston 22 through the inlet 222, the inlet ball 72 is pushed by the brake oil. When the inlet ball 72 is pushed by the brake oil as described above, the inlet spring 71 is compressed, and the inlet ball 72, which has closed the inner passageway 221, becomes spaced apart from the inner passageway 221, such that the inner passageway 221 is opened.

Figure 2B:
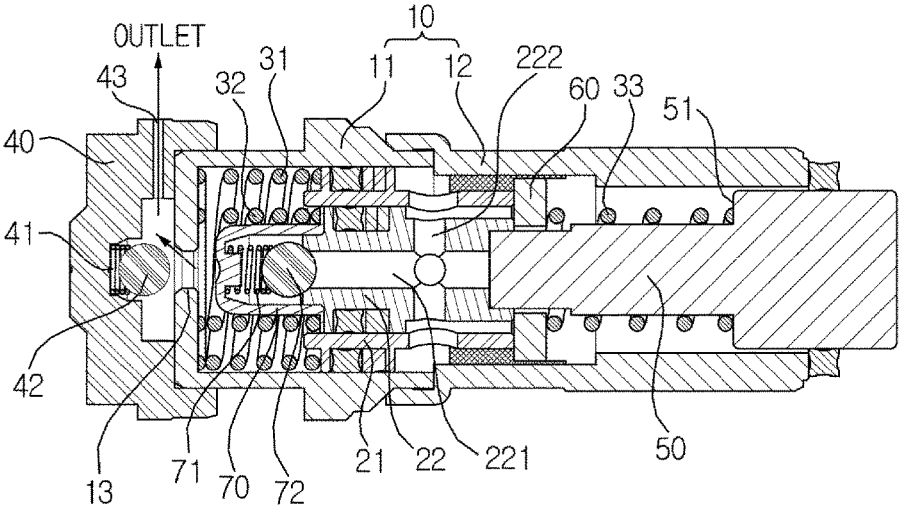

When the inlet ball 72 is opened, the brake oil flows into the sleeve 11 through the inner hole 221. When the brake oil flows into the sleeve 11, the inlet spring 71, which has been compressed, is extended simultaneously, and the inlet ball 72 closes the inner passageway 221, as shown in FIG. 2B.

In this state, the piston rod 50 rectilinearly reciprocates in conjunction with an operation of the motor cam, and thereby, the piston rod spring 33 and the stopper plate 60 push the outer piston 21 and the inner piston 22 in a direction toward the sleeve 11.

Both of the outer piston 21 and the inner piston 22 rectilinearly reciprocate, such that a space in the sleeve 11 is compressed. As the space in the sleeve 11 is compressed, the outlet spring 41 is compressed, and the outlet valve 42 is pushed, such that the opening and closing hole 13 of the sleeve 11 is opened, as shown in FIG. 2B.

The brake oil in the sleeve 11 flows into the cap 40 through the opened opening and closing hole 13, and then is discharged through the outlet 43. In this case, the outlet spring 41, which has been compressed, is extended to the original state, and the outlet valve 42 closes the opening and closing hole 13 of the sleeve 11, as shown in FIG. 2A.

As described above, when pressure applied to the outlet 43 is less than force of the piston rod spring, both of the outer piston 21 and the inner piston 22 rectilinearly reciprocate and discharge the brake oil, such that a discharge rate of the pump is increased. That is, in comparison with the case in which only the inner piston 22 rectilinearly reciprocates, the discharge volume is increased, and thus, the discharge rate of the pump is increased when both of the outer piston 21 and the inner piston 22 rectilinearly reciprocate.

Next, an operation of the piston pump for a brake when pressure applied to the outlet is greater than force of the piston rod spring will be described.

Figure 3A:
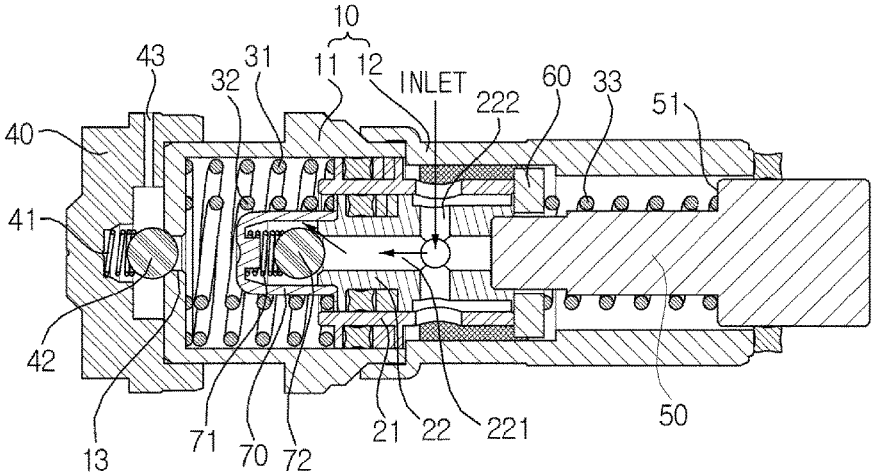
FIG. 3A and FIG. 3B are views illustrating an operating state of the piston pump for a brake according to the exemplary embodiment of the present invention when force higher than force of the piston rod spring is applied to the outlet.

As illustrated in FIG. 3A, the brake oil flows into the inner passageway 221 of the inner piston 22 through the inlet 222. When the brake oil flowing into the inner piston 22 pushes the inlet ball 72, the inner passageway 221 is opened while the inlet ball 72 is pushed. As the inlet ball 72 is pushed, the inlet spring 71 is compressed.

Figure 3B:
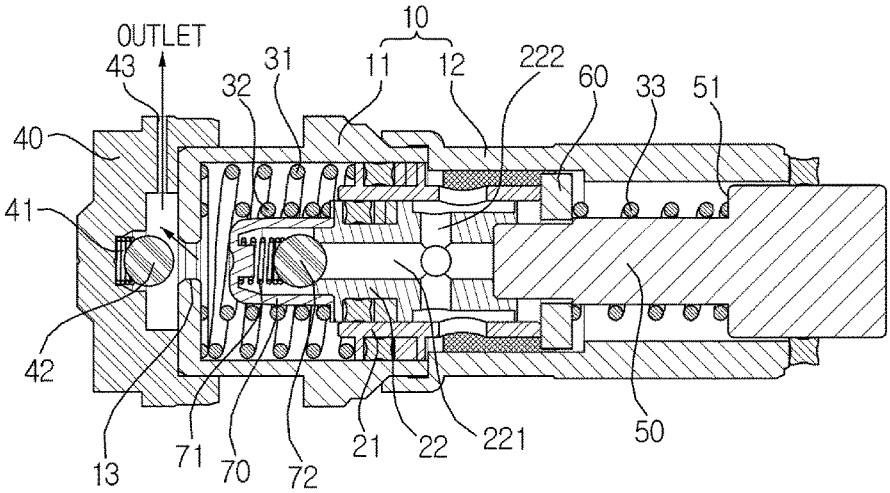

When the inner passageway 221 is opened, the brake oil in the inner piston 22 simultaneously flows into the sleeve 11. When the brake oil flows into the sleeve 11, the inlet spring 71, which has been compressed, is extended, such that the inlet ball 72 closes the inner passageway 221, as shown in FIG. 3B.

In this case, the piston rod 50 rectilinearly reciprocates in conjunction with an operation of the motor cam, such that the piston rod spring 33 is compressed. In this case, a stopped state of the outer piston 21 is maintained. By the operation of the piston rod 50, the inner piston 22 connected with the piston rod 50 rectilinearly reciprocates alone.

As the inner piston 22 rectilinearly reciprocates, a space in the sleeve 11 is compressed. As the space in the sleeve 11 is compressed, the outlet valve 42, which has closed the opening and closing hole 13 of the sleeve 11, is pushed, such that the opening and closing hole 13 of the sleeve 11 is opened.

The brake oil in the sleeve 11 flows into the cap 40 through the opening and closing hole 13, and then is discharged through the outlet 43 of the cap 40. In this case, as the outlet spring 41, which has been compressed, is extended, the outlet valve 42 closes the opening and closing hole 13 of the sleeve 11.

As described above, only the inner piston 22 rectilinearly reciprocates when pressure applied to the outlet 43 is greater than the force of the piston rod spring, such that a pressure load applied to the piston is smaller than that when both of the outer piston 21 and the inner piston 22 rectilinearly reciprocate, thereby reducing a load applied to a motor.

According to the piston pump for a brake according to the exemplary embodiments, when low pressure is applied to the outlet, both the outer piston and the inner piston are operated and discharge brake oil, thereby increasing a discharge rate of the pump.

When high pressure is applied to the outlet, only the inner piston is operated, thereby reducing a load applied to a motor.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A piston pump for a brake, comprising:

a piston housing;

an outer piston configured to rectilinearly reciprocate in the piston housing;

an inner piston coupled to an inner portion of the outer piston, and configured to rectilinearly reciprocate together with the outer piston whenever the inner piston is coupled to the inner portion of the outer piston, or to rectilinearly reciprocate alone whenever the outer piston is stopped;

an outer return spring supporting a tip portion of the outer piston;

an inner return spring supporting a tip portion of the inner piston;

a piston rod spring supporting rear end portions of the outer piston and the inner piston;

a spring cage coupled to a front portion of the inner piston; and an inlet ball disposed in the spring cage, wherein:

the tip portion of the outer piston is supported by the outer return spring that is disposed at a front side of the interior of the piston housing;

the tip portion of the inner piston is supported by the inner return spring disposed at the front side of the interior of the piston housing;

the inner return spring has a smaller outer diameter than the outer return spring;

the inlet ball is supported by an inlet spring and is configured to open and close an inner passageway disposed in the inner piston; and the spring cage protrudes into interior portions of both the outer return spring and inner return spring.

2. The piston pump of claim 1, wherein the piston housing comprises:

a sleeve; and a filter comprising a tip portion coupled to a rear portion of the sleeve.

3. The piston pump of claim 1, further comprising:

a cap coupled to a front portion of the piston housing; and an outlet valve disposed in the cap, wherein the outlet valve is supported by an outlet spring and is configured to open and close an opening and closing hole that is formed in the front portion of the piston housing so as to communicate with the interior of the piston housing.

4. The piston pump of claim 3, wherein an outlet is disposed at one side of the cap and is configured to communicate with the interior of the cap.

5. The piston pump of claim 3, wherein the outlet valve is formed in the form of a ball or a plate.

6. The piston pump of claim 1, further comprising a piston rod coupled to a rear portion of the inner piston.

7. The piston pump of claim 6, wherein further comprising a stopper plate, which supports the rear end portions of the outer piston and the inner piston, coupled to the piston rod.

8. The piston pump of claim 7, wherein the piston rod spring, which supports the stopper plate, is disposed between the stopper plate and a stepped portion that is disposed at a rear end of the piston rod.

9. The piston pump of claim 1, wherein an inlet, which communicates with an inner hole provided in the inner piston, is formed at one side at a rear side of the inner piston.

* * * * *